United States Patent [19]

Yatsushiro et al.

[11] 4,424,505

[45] Jan. 3, 1984

[54] ELECTRIC COIL ASSEMBLY

[75] Inventors: Kenji Yatsushiro, Chicago; George F. Kuchuris, Bloomingdale, both of Ill.

[73] Assignee: The Singer Company, Stamford, Conn.

[21] Appl. No.: 473,937

[22] Filed: Mar. 10, 1983

[51] Int. Cl.[3] ..... H01F 15/10; H01F 27/30

[52] U.S. Cl. ..... 336/90; 336/192; 336/208

[58] Field of Search ..... 336/192, 208, 198, 90, 336/92, 209

[56] References Cited

U.S. PATENT DOCUMENTS

| | | | |
|---|---|---|---|
| 2,132,833 | 10/1938 | Quam | 336/192 X |
| 3,230,490 | 1/1966 | Johnson | 336/192 X |
| 3,470,511 | 9/1969 | Heinzen | 336/192 X |
| 4,091,349 | 5/1978 | Niederjohn et al. | 336/192 |
| 4,105,985 | 8/1978 | Plunkett | 336/192 X |

*Primary Examiner*—Thomas J. Kozma

*Attorney, Agent, or Firm*—David L. Davis; Robert E. Smith; Edward L. Bell

[57] ABSTRACT

A coil assembly has a pair of terminals mounted in blind slots in the small flange of a bobbin. Magnet wire is connected to one terminal, wound on the bobbin and connected to the other terminal. Insulated lead wires are connected to the terminals by crimping and then soldering each terminal. Then the terminals are bent over the coil and the insulated wires are pressed through a slot leading to an opening in the larger flange. A cover encloses the bobbin and snaps over the rim of the large flange to complete the assembly.

11 Claims, 8 Drawing Figures

ELECTRIC COIL ASSEMBLY

DESCRIPTION

Background of the Invention

Electrical coils are judged by various criteria. For example, the coil should have high electrical resistance to ground. Further, in coils which are not encapsulated, the magnet wire is wound (covered) with insulating tape which involves hand work. That rules out automation which means costs increase. Additionally, the lead wires are connected to terminals to which the magnet wire is connected. The lead wires and terminals should resist pull-out to stand up to rough handling.

SUMMARY OF THE INVENTION

The object of this invention is to improve the resistance to ground and the resistance to lead pull-out while reducing the cost of electrical coils.

The design permits use of a plastic cover which provides superior electrical resistance to ground and does so without use of electrical tape. This design approach makes automation possible. The terminals are firmly mounted in a flange of the bobbin. The lead wires are crimped to terminals and are also soldered. After the magnet wire has been wound, the terminals are bent over the coil to allow a cover to fit over the flange and coil and snap-fit over a larger flange of the bobbin. The snap-fit cover is a simple, fast way to complete the assembly. The cover includes an electrical barrier which fits between the lead wires where they exit through an opening in the larger flange. The internal terminals for the lead wires coupled with the crimped and soldered connection and the lead dress with a 90° bend gives high resistance to lead pull-out.

DETAILED DESCRIPTION OF THE DRAWINGS

Figure 1:
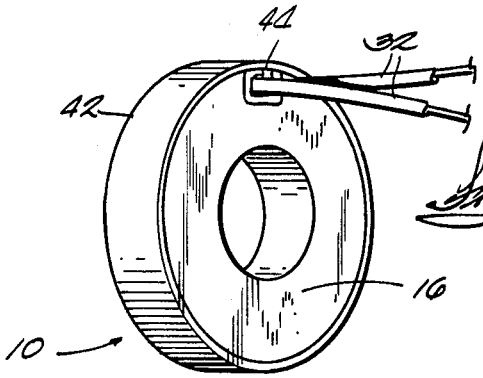
FIG. 1 is a perspective view of the assembled coil.
Figure 2:
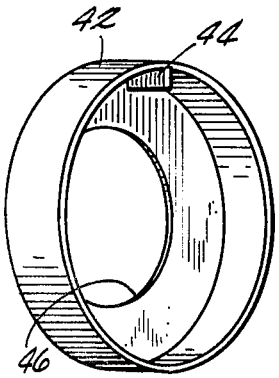
FIG. 2 is an exploded perspective view of the coil.
Figure 3:
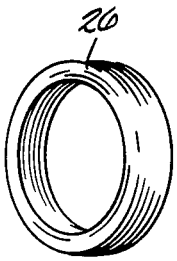
FIG. 3 is a side elevation of the bobbin.
Figure 3:
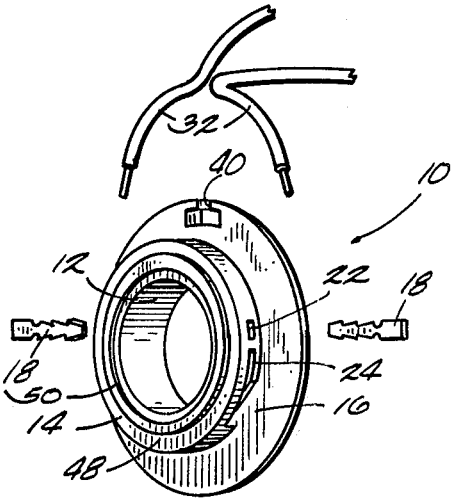
Figure 3:
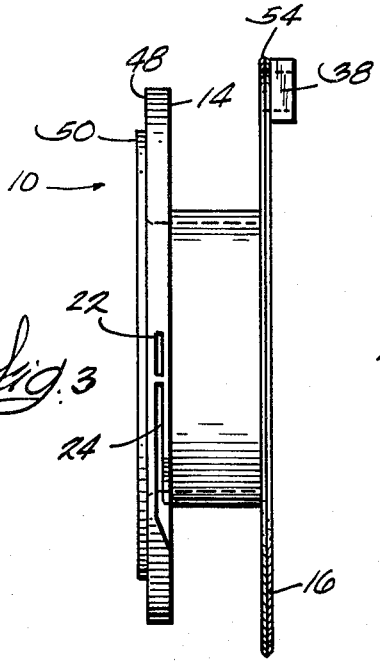
Figure 4:
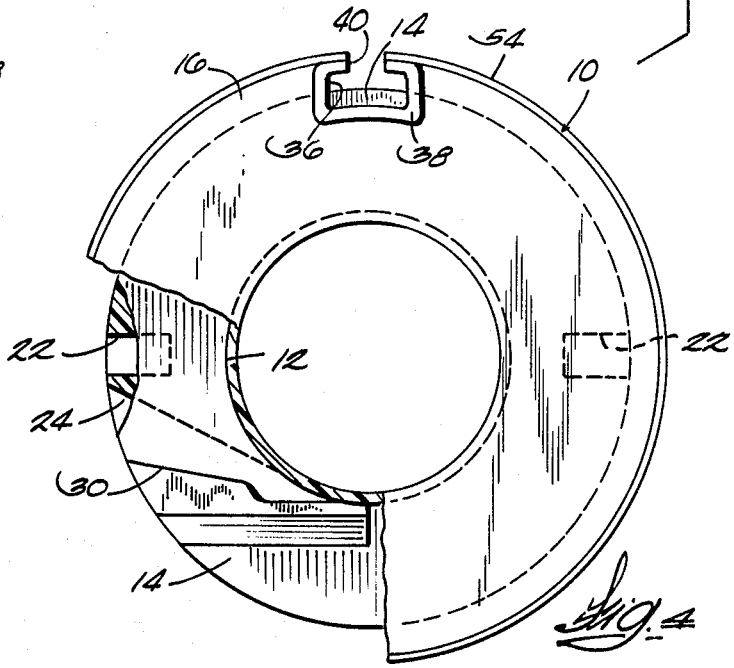
FIG. 4 is a front elevation of the bobbin with part of the larger flange broken away and part of the smaller flange also broken.
Figure 5:
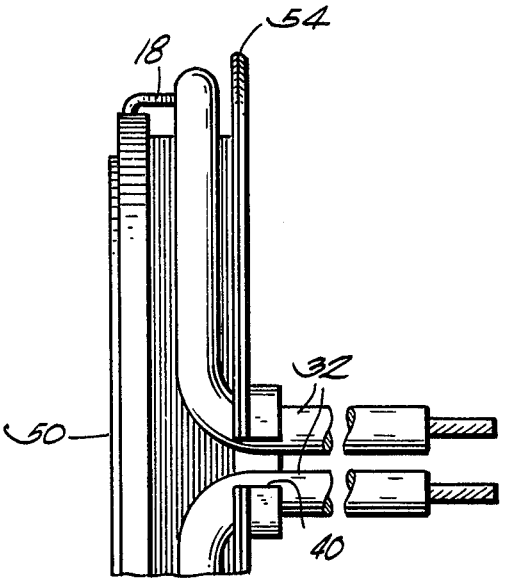
FIG. 5 is a fragmentary detail view showing the manner in which the lead wires are dressed.
Figure 6:
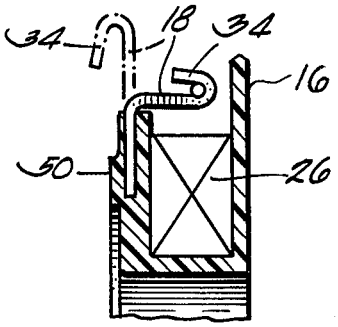
FIG. 6 is a fragmentary view showing in full lines the final position of the terminal after it is bent from the dotted line position.
Figure 7:
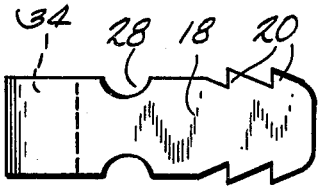
FIG. 7 is a detail view of the terminal.
Figure 8:
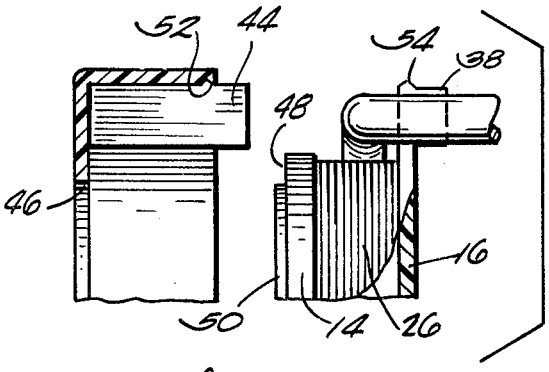
FIG. 8 is a detailed exploded view partly in section showing the cover and bobbin.

The basic component in the electrical coil is the plastic bobbin 10 which has a spool 12 with end flanges 14, 16. Flange 16 has a larger diameter than flange 14. Diametrically opposed terminals 18 having barbs 20 on its shank are forced into the blind holes or slots 22. The barbs prevent withdrawal. There is a lead-in slot 24; the base of which is tangential to the spool, adjacent the slot 22 on the left in FIG. 4 and on the right in FIG. 2. This permits the magnet wire 26 to be wound on the terminal at neck 28 and lead inside the lead-in slot 24 to the spool. Then the wire is wound on the bobbin the requisite number of turns while the lead-in wire is protected by (hidden behind) the wall 30 of the slot 24. The end of the wire is then connected to the other terminal 18.

During winding, both terminals 18 lie in the plane of flange 14 and do not interfere with the winding.

Insulated lead wires 32 are then connected to the terminals 18. Each terminal 18 has a "hooked" end 34. The bare conductive end of a lead wire 32 is placed in the end 34 and the end 34 is then crimped onto the wire 32. Then both terminals 18 are (dip) soldered. Then the terminals 18 are bent 90° to lie over the coiled magnet wire 26 at a lesser diameter than the larger flange 16.

The larger flange 16 has an opening 36 surrounded by a shoulder 38 which increases the load bearing surface to lower the unit area pressure on the insulated wires 32 dressed through the opening 36 by pressing the wires through the slot 40 leading from the periphery of the flange 16 to the opening 36. The width of the slot 40 is a little less than the diameter of the insulated wire 32 so the wire has to be slightly forced through the slot 40 into the opening 36 but will stay there during further handling until the assembly is completed. The wires can only be in a side-by-side relationship in the opening 36. Then when the cover 42 is placed over the bobbin 10 from the small flange 14 end, the barrier tang 44 inside the cover 42 will fill the slot 40 and fit between the wires 32, 32 to project out to the plane of the shoulder 38. The inside of the annular portion of the cover 42 adjacent central hole 46 will abut the surface 48 on flange 14 between annular boss 50 and the rim of the flange 14, thus fixing the cover 42 relative to the flange 14 while the groove 52 inside the cylindrical skirt of the cover snaps over the shaped edge 54 of flange 16.

The coiled magnet wire 26 is well insulated from ground by the snap-on cover 42 with the barrier tang 44 and wires 32 filling the slot 40 and opening 36. The wires 32 are crimped and soldered to terminals 18 which lock into the flange 14. The wires 32 have a 90° bend adjacent the exit opening 36 and any pull on the wire 32 is greatly dissipated by pulling against the flange 16 which is reinforced by shoulder 38.

This coil has superior mechanical and electrical qualities and costs 15% less than the coil it replaces.

We claim:

1. An electrical coil assembly comprising:

a bobbin having a large flange at one end and a small flange at the other end;

two terminals fixed on the small flange;

magnet wire connected to one terminal and wound on the bobbin and connected to the other terminal;

an insulated lead wire connected to each terminal;

an opening in the large flange radially beyond the coiled magnet wire, both of the insulated lead wires passing through said opening; and a cover having an annular portion abutting the small flange and a cylindrical portion which fits over the rim of the large flange.

2. A coil assembly according to claim 1 in which the terminals overlie the coiled magnet wire.

3. A coil assembly according to claim 2 in which each terminal is mounted in a blind hole in the small flange and has barbs which engage the sides of the hole to prevent removal of the terminal.

4. A coil assembly according to claim 3 in which each terminal is crimped onto the bare conductive wire of the insulated wire.

5. A coil assembly according to claim 4 in which each connection of each terminal to the insulated wire is soldered.

6. A coil assembly according to claim 1 in which the cylindrical portion of the cover is provided with an internal groove which snaps over the rim of the large flange.

7. A coil assembly according to claim 6 including a tang on the cover fitting between the insulated wires where they pass through said opening.

8. A coil assembly according to claim 7 wherein the large flange includes a slot extending from its rim to said opening to allow the insulated wires to be pressed into the opening, the width of the slot being about the same as or slightly smaller than the outside diameter of the insulated wire.

9. A coil assembly according to claim 1 including a shoulder surrounding said large flange opening and projecting axially a short distance to increase the load bearing surface at the opening.

10. A coil assembly according to claim 9 in which each insulated wire is connected to its respective terminal by crimping the terminal onto the wire and by soldering the connection.

11. An electrical coil assembly comprising:

a bobbin including a spool having a flange at each end, the flanges having different diameters;

a pair of blind slots in the rim of the smaller flange;

a pair of terminals each mounted in a respective slot;

magnet wire connected to one terminal, wound on the spool and connected to the other terminal;

a pair of insulated lead wires each connected to a respective terminal;

an opening adjacent the perimeter of the larger flange, said lead wires being positioned in said opening; and a cover engaging the outside of the smaller flange and having a snap fit on the rim of the larger flange.

* * * * *